United States Patent [19]

Hestehave

[11] Patent Number: 4,588,111

[45] Date of Patent: May 13, 1986

[54] VENTED POURING SPOUT

[76] Inventor: Kjeld Hestehave, 1584 Albright Ave., Upland, Calif. 91786

[21] Appl. No.: 259,165

[22] Filed: Apr. 30, 1981

Related U.S. Application Data

[63] Continuation-in-part of Ser. No. 92,030, Nov. 7, 1979, abandoned.

[51] Int. Cl.[4] ..... B67D 3/00

[52] U.S. Cl. ..... 222/479; 222/568; 220/85 SP

[58] Field of Search ..... 222/478, 479, 566, 567, 222/568, 572, 573, 481.5; 220/85 SP

[56] References Cited

U.S. PATENT DOCUMENTS

| | | | |
|---|---|---|---|
| 227,697 | 5/1880 | Massey | 222/479 X |
| 523,580 | 7/1894 | Kinsey | 222/554 |
| 1,849,950 | 3/1932 | Murdock | 222/573 X |
| 2,040,545 | 9/1934 | Byers | 215/74 |
| 2,841,313 | 7/1958 | Beall | 222/479 |
| 2,992,761 | 7/1961 | Sommers | 222/479 |
| 3,372,846 | 3/1968 | Berkus | 222/479 |
| 3,834,594 | 9/1974 | Schiemann | 222/479 X |
| 3,934,760 | 1/1976 | LeGresley | 222/478 X |
| 4,034,901 | 7/1977 | Kirk | 222/481.5 |
| 4,273,265 | 6/1981 | Anderson | 222/479 X |

FOREIGN PATENT DOCUMENTS

| | | | |
|---|---|---|---|
| 203739 | 9/1923 | United Kingdom | 222/481.5 |

*Primary Examiner*—Joseph J. Rolla
*Assistant Examiner*—Kevin P. Shaver
*Attorney, Agent, or Firm*—Sixbey, Friedman & Leedom

[57] ABSTRACT

A pouring spout, for use on a container, of the type having a tubular spout member with a pouring passage therethrough and a venting passage extending within the pouring passage is improved by forming the venting passage in a venting tube that is attached to the spout member and has an inlet end portion that extends outwardly from the pouring passage at its inlet end in a manner that is curved upwardly so that a free end thereof would be within an air space formed in the container during a pouring operation. According to a first embodiment, the venting tube is a separate element from the pouring spout that is clipped within its pouring passage. According to another embodiment, the venting passage is unitarily formed with the spout member.

3 Claims, 7 Drawing Figures

5
7
A
B
10
A
9
3
2
C
8
4

2
10

2'
6

5'
B
A
A
2'
3'
9'
C
4'

1
9'

VENTED POURING SPOUT

BACKGROUND AND SUMMARY OF THE PRESENT INVENTION

The present application is a continuation-in-part of co-pending U.S. patent application Ser. No. 092,030, filed Nov. 7, 1979, now abandoned.

In the above-noted application, an improved pouring spout for containers, and, more particularly, an improved pouring spout of the retractable type disclosed for use with portable containers in U.S. Pat. No. 3,372,846, is disclosed wherein the spout has a unitarily molded, internal venting passage that extends approximately two thirds of the distance from an outlet end of the spout to the inlet end of the spout, terminating just short of an angular bend in the spout.

Other examples of pour spouts having internal, integral venting passages can be found in U.S. Pat. Nos. 523,580; 2,040,545; 2,841,313; and 2,992,761.

All of the above-noted prior art spouts with internal venting passages have a common attribute that the inlet end of the venting passage is located internally of the pouring spout, in a sidewall of the pouring spout, or protruding a slight distance from the inlet end of the pouring spout. While such arrangements can act, in most instances, to insure that a smooth and even discharge of the contents of the container can be achieved through the spout without it being impeded by a "gurgling" effect resulting from the pressure inside the container becoming less than the external pressure, under some circumstances, the contents of the container will flow into or otherwise separate the inlet end of the vent passage from directly communicating air outside of the container with an air space that is formed inside of the container, such that the "gurgling" effect occurs and flow is somewhat impeded.

Accordingly, it is an object of the present invention to provide an improved pouring spout for use with dispensing containers of the internally vented spout type that will provide increased venting reliability.

Another object of the invention is to provide a spout of the abovenoted type which can be easily and inexpensively produced.

According to the present invention, the aforenoted objects are achieved by providing a pouring spout having a tubular spout member with a pouring passage and a venting passage that extends within the pouring passage, the venting passage being formed by a venting tube attached to the spout member and having an inlet end portion extending outwardly from the pouring passage at the inlet end of the spout member and the inlet end portion is curved in a manner which, in use during pouring, extends from the pouring passage and is directed generally upwardly so that a free end thereof will be within an airspace formed in the container.

In accordance with a first embodiment of the present invention, the venting tube is a separate element from the pouring spout, and is clipped thereto by a clip formed unitarily with the interior wall of the spout member.

According to another embodiment, the venting tube is formed unitarily with the spout member.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
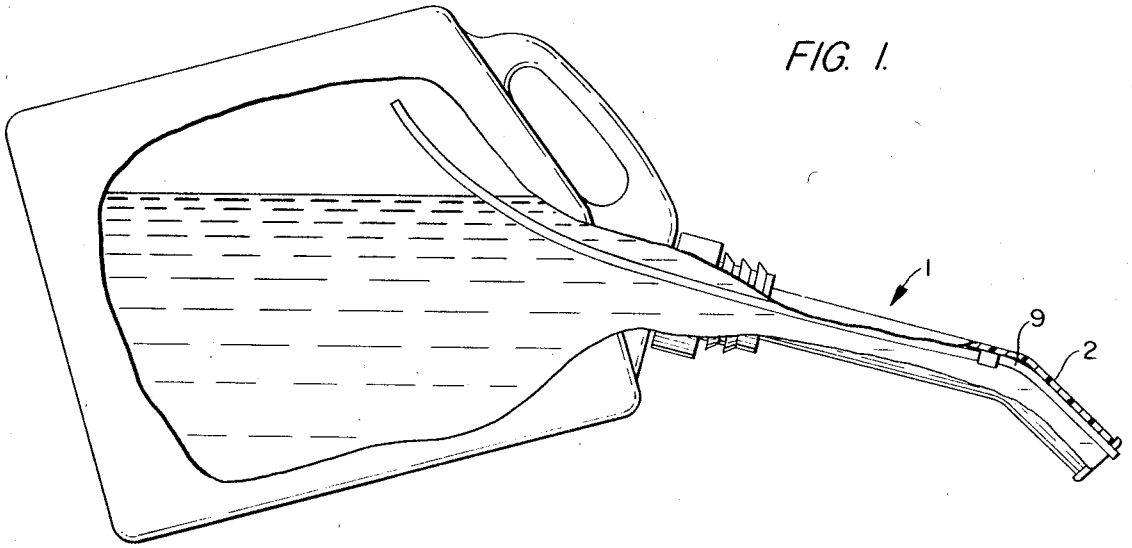
FIG. 1 is a schematic illustration of a pouring spout in accordance with the present invention utilized with a container during pouring.

As is shown in the drawings, the pouring spout generally indicated at 1 comprises a spout member 2 having a longitudinal pouring passage 3 extending from the inlet end 4 of the spout member to the outlet end 5 of the spout member. An attaching cap 6 is slidably received on the spout member 2, and is retained thereon by a bead 7 and by a flaring 8 of the inlet end 4. However, the displaceable relationship between the cap 6 and spout member 2 as well as the manner of retaining same form no part of the present invention, such being discussed in greater detail in U.S. Pat. No. 3,372,846, and as such, no further description is believed to be necessary for the purpose of understanding the present invention.

With reference to FIG. 1, in accordance with the present invention, a venting tube 9 is provided within the pouring spout 1 and is positioned so as to extend from an outlet end, that projects slightly from the outlet end 5 of spout member 2, to an inlet end that extends from inlet end 4 and is directed generally upwardly so that a free end thereof will be located within the air space formed in the container above the fluid level. Since the vent tube 9 extends directly into the air space, it is not necessary for the venting air to bubble through the fluid contents of the container during pouring, even if the container is turned downwardly sufficient to fill the entire diameter of the spout member 2 and the neck area of the container surrounding the inlet end of the spout.

Figure 2:
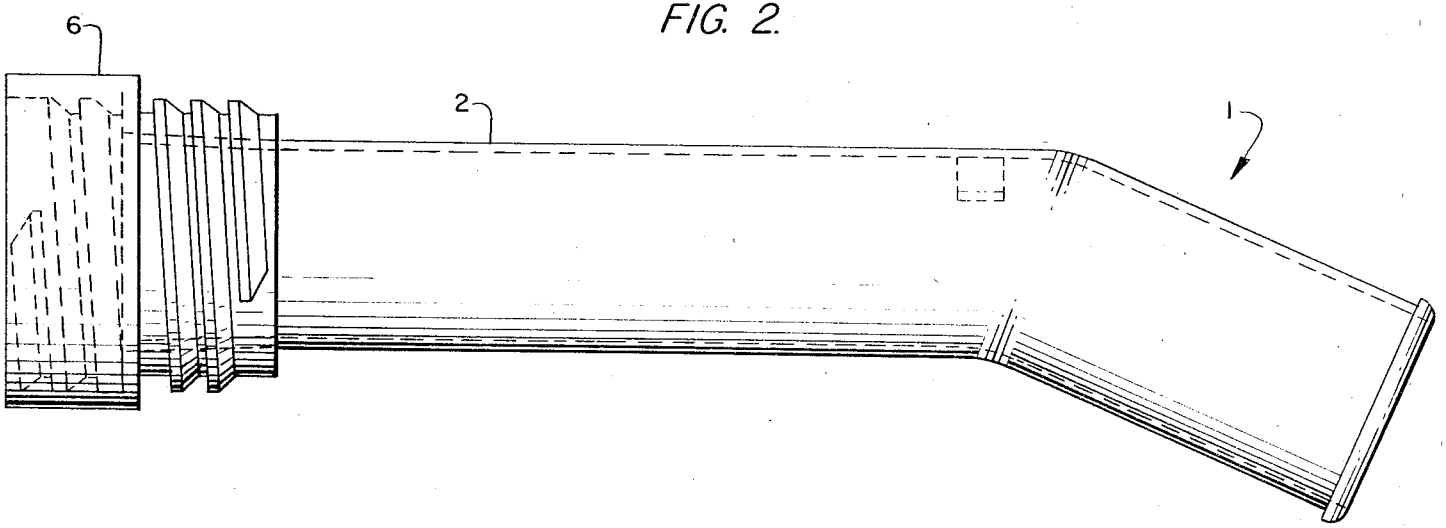
FIG. 2 is a side elevational view of a preferred embodiment pouring spout.
Figure 3:
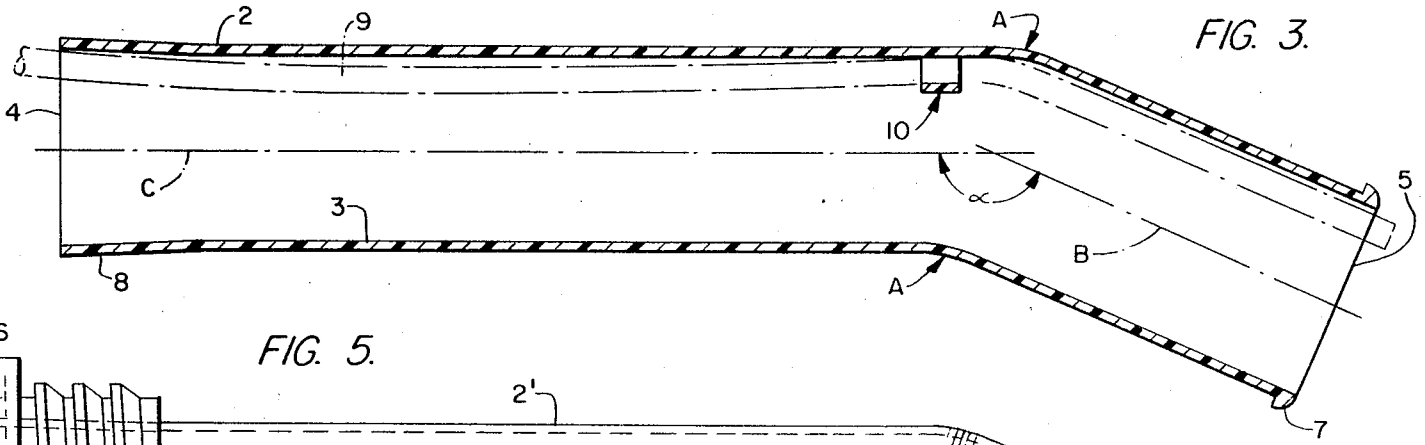
FIG. 3 is a longitudinal cross sectional view through the spout member of the pouring spout of FIG. 2.
Figure 4:
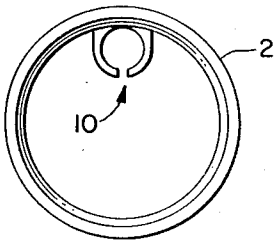
FIG. 4 is an inlet end view of the spout member of FIG. 3.

In accordance with a first embodiment shown in FIGS. 2–4, the vent tube 9 is attached within the pouring passage 3 by way of a clip 10. To facilitate pouring of the entire contents of a container of the type shown in FIG. 1, without having to entirely invert same, a bend of "A" is provided approximately one third of the distance from the outlet end 5 toward the inlet end 4 of the spout member 2. Such a bend preferably creates an angle $\alpha$ of approximately 150°–155° between the longitudinal axis B extending through the outlet end and the longitudinal axis C through the inlet end. While such a spout configuration is advantageous, it is not essential for practice of the venting concept in accordance with the present invention. However, if such a bend is provided, it has been found that the location of the clip 10 shown in FIGS. 2 and 3 at the inlet side of bend A is advantageous in that it enables the clip 10 to be unitarily formed with the spout member 2 by injection molding in an easy manner, and at the same time enables the venting tube 9 to be easily attached and properly held in position by only the one bifurcated clip. When the flexible, curved venting tube 9 is held by the clip 10, it assumes a longitudinal configuration that is generally s-shaped.

Figure 5:
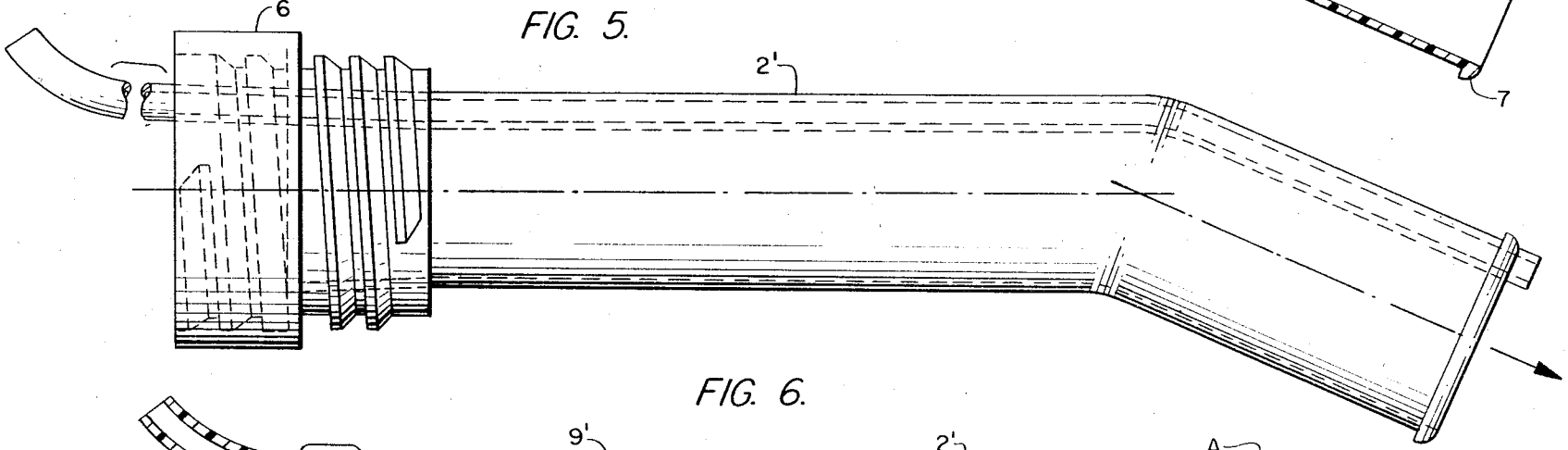
FIGS. 5–7 correspond to FIGS. 2–4, respectively, but are illustrative of a modified embodiment of the present invention.
Figure 6:
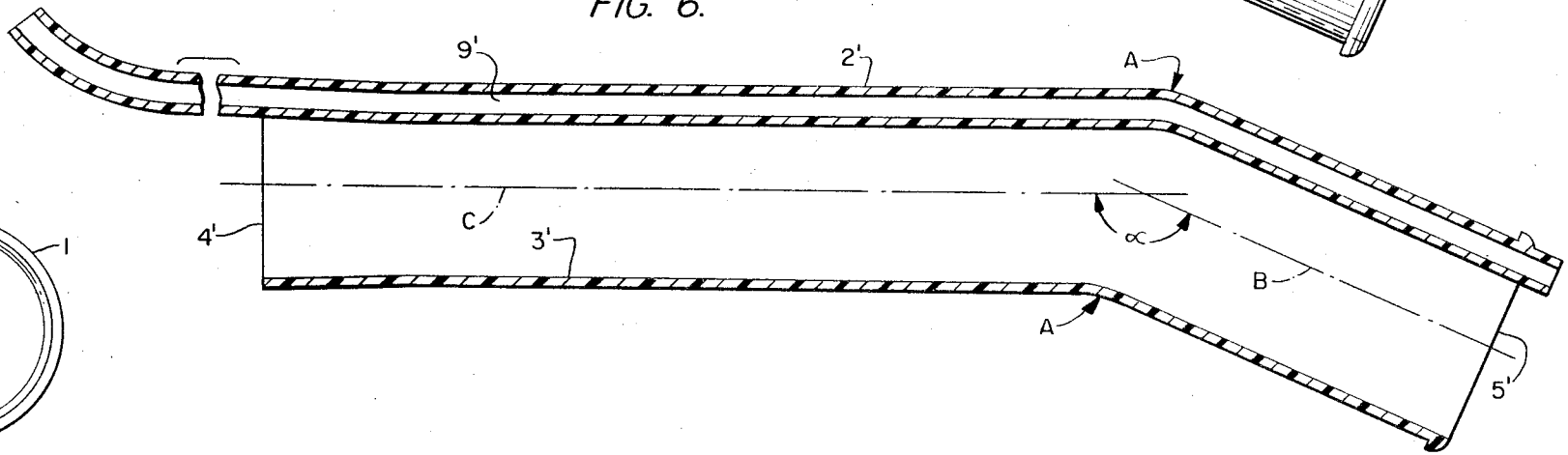
Figure 7:
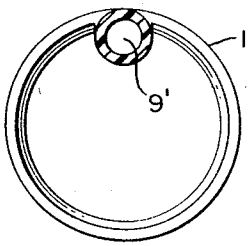

FIGS. 5–7 show a modified embodiment wherein the venting tube, instead of being a separate tube that is attached within the pouring passage 3, is a unitarily molded passage 9' formed as part of the wall defining the pouring passsage 3' of the spout member 2'. However, as can be seen from FIGS. 5 and 6, the venting passage 9' is not coextensive in length with the pouring spout 2', but rather has a short tubular extension at the outlet end 5' and an arcuately upwardly extended tubular portion at the inlet end. In this regard, the projecting tubular portion at the outlet end, while advantageous, is not essential. On the other hand, the arcuately, upwardly, extending tubular portion at the inlet end of the spout member is essential to the practice of the invention, this portion being of a length and shape designed to reach into an area of containers to which the spout is attachable that will, at least shortly after commencement of a pouring operation, contain an air space.

While the embodiment of FIGS. 5–7 does have advantages over the embodiment of FIGS. 3–4 in that it avoids any assembly steps with regard to attachment of a venting tube to the spout member, the embodiment of FIGS. 2–4 is preferably in that, through use of a venting tube that is considerably longer than the length of the spout, the spout can be adapted for use to the specific needs of various different containers and pouring angles, by virtue of the fact that the venting tube can be longitudinally shifted relative to the spout member. Additionally, since the separate tube 9 is not only longitudinally displaceable within clip 10, but also rotatably displaceable within the clip 10 upon application of sufficient force to overcome the resilient clamping pressure applied by the clip 10, the venting tube 9 can be rotated so as to insure that it is turned to an orientation that will allow for air passage.

From the foregoing description, it can be seen that the present invention provides an improved pouring spout that gives even, smooth flow and prevents the production of excessive "gurgling" by satisfactorily venting containers with which it is associated.

While I have shown and described various embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. In a retractable pouring spout, for use on a container, of the type having a tubular spout member with a pouring passage extending from an inlet end of the spout to an outlet end thereof, an attaching cap within which said spout member is slideably received for axial reciprocation between a pouring position projecting outwardly from the top of said cap and a retracted position projecting outwardly from the bottom of said cap, and a venting passage extending within said pouring passage, the improvement wherein said venting passage is formed in a separate venting tube of resiliently flexible material having a generally S-shaped longitudinal configuration that is substantially longer than the length of said spout member, wherein said spout member has an obtuse angle bend at a location approximately one-third the distance from its outlet end toward its inlet end, said venting tube being resiliently clamped to the spout member solely at a location within said pouring passage adjacent an inlet end side of said bend, wherein said venting tube extends outwardly from the inlet end of the spout member in an unsecured manner and is longitudinally and displaceably shiftable, while remaining clamped to said spout member, upon application of sufficient force to overcome the pressure by which it is resiliently clamped for enabling said venting tube to be positionally adjusted for proper venting in accordance with the specific needs of various different containers and pouring angles.

2. A pouring spout according to claim 1, wherein said spout member is of molded plastic and the venting tube is clamped to said spout member by a clip that is a unitarily molded portion of said spout member at a location within said pouring passage adjacent said inlet end side of said bend.

3. A pouring spout according to claim 1, wherein said venting tube extends outwardly from the pouring passage at the outlet end of the spout member.

* * * * *